US005111881A

United States Patent [19]

Soliman et al.

[11] Patent Number: 5,111,881

[45] Date of Patent: May 12, 1992

[54] METHOD TO CONTROL FRACTURE ORIENTATION IN UNDERGROUND FORMATION

[75] Inventors: Mohamed Y. Soliman, Lawton; James J. Venditto, Duncan, both of Okla.; A. Ali Daneshy, Leiden, Netherlands

[73] Assignee: Halliburton Company, Duncan, Okla.

[21] Appl. No.: 579,126

[22] Filed: Sep. 7, 1990

[51] Int. Cl.[5] ..... E21B 43/267; E21B 49/00

[52] U.S. Cl. ..... 166/250; 166/281; 166/297; 166/308

[58] Field of Search ..... 166/271, 281, 297, 308, 166/250

[56] References Cited

U.S. PATENT DOCUMENTS

| | | | |
|---|---|---|---|
| 3,289,762 | 12/1966 | Schell et al. | 166/297 X |
| 3,537,529 | 11/1970 | Timmerman | 166/271 |
| 4,005,750 | 2/1977 | Shuck | 166/308 |
| 4,669,546 | 6/1987 | Jennings, Jr. et al. | 166/308 |
| 4,687,061 | 8/1987 | Uhri | 166/308 |
| 4,718,490 | 1/1988 | Uhri | 166/281 |
| 4,724,905 | 2/1988 | Uhri | 166/250 |
| 4,830,106 | 5/1989 | Uhri | 166/250 |
| 4,834,181 | 5/1989 | Uhri et al. | 166/281 |
| 4,850,431 | 7/1989 | Austin et al. | 166/308 |
| 4,869,322 | 9/1989 | Vogt, Jr. et al. | 166/308 X |
| 4,974,675 | 12/1990 | Austin et al. | 166/308 X |
| 4,977,961 | 12/1990 | Avasthi | 166/297 |

OTHER PUBLICATIONS

Warpinski et al., Altered-Stress Fracturing, SPE 17533 (presented at SPE Rocky Mountain Regional Meeting, Casper, Wyo., May 11-13, 1988).

Kuhlman, Microfrac Tests Optimize Frac Jobs, *Oil & Gas Journal*, 45-49 (Jan. 1990).

Daneshy et al., In-Situ Stress Measurements During Drilling, *Journal of Petroleum Technology*, 891-898 (Aug. 1986).

L. W. Teufel, Determination of In-Situ Stress from Anelastic Strain Recovery Measurements of Oriented Core, *SPE/DOE* 11649, Mar. 1983.

Sneddon and Elliot, The Opening of a Griffith Crack Under Internal Pressure, *Quarterly of Applied Mathematics*, vol. 4, No. 3, p. 262 (1946).

Green and Sneddon, Distribution of Stress in the Neighborhood of a Flat Elliptical Crack of an Elastic Solid, *Proceedings Cambridge Phil. Soc.* pp. 159-163 (Jan. 1949).

*Primary Examiner*—George A. Suchfield
*Attorney, Agent, or Firm*—Robert A. Kent

[57] ABSTRACT

This invention relates to a procedure to control fracture orientation in underground formations to increase well productivity. The method is performed by hydraulically fracturing the formation and propping and plugging the fractures which result. The formation is then perforated or notched in a direction angularly disposed relative to the anticipated fracture formation and first hydraulic fracture. The presence of the first fracture will force the second fracture to propagate in a direction away from that of the first fracture. A method for simultaneously fracturing the formation in two directions is also provided.

11 Claims, 1 Drawing Sheet

METHOD TO CONTROL FRACTURE ORIENTATION IN UNDERGROUND FORMATION

BACKGROUND OF THE INVENTION

This invention relates to a method of controlling the fracture orientation of hydraulic fractures in underground formations to increase well productivity.

Hydraulic fracturing is a well established method used in the oil and gas industry for reservoir stimulation. The general technique is to inject fluid under high pressure into a well-bore and perforated formation to create fractures in the hydrocarbon bearing formation. It was first applied in the oil industry in 1948 to stimulate productivity from low permeability oil bearing formations.

A problem frequently encountered with hydraulic fracturing is that the fracture orientation is not optimal for maximum well productivity. The orientation of a fracture in an underground formation is generally controlled by the in-situ stress of the formation. The formation is subjected to three principal stresses, one vertical and two horizontal. When a formation is hydraulically fractured the created fracture should propagate in the path of least resistance or, in other words, the fracture will be perpendicular to the least principal stress.

In deeper formations (generally below 2000 ft.), one of the horizontal stresses is usually the smallest stress because of the high weight of the rock. Consequently, a vertical fracture is created. The above is also generally true for any natural fracturing which may be present in the formation. It is a common experience that augmenting either natural or man-made hydraulic fractures with further hydraulic fracturing results in parallel fractures which do not significantly increase the productivity of the well.

Warpinski et al. (SPE 17533, SPE Rocky Mountain Regional Meeting, Casper, Wyo., May 11-13, 1988) suggests that the technique of altered stress fracturing may be used to overcome the problem of hydraulic fracturing paralleling permeable natural fractures. Warpinski et al. discusses the concept of using an offset well to create hydraulic fractures that alter a stress field around a production well. It states that if the stress difference is not too large, the wells are relatively close together and the treatment pressures and fracture sizes in the offset wells are sufficiently large, enough stress can be added to the virgin minimum horizontal in situ stress to make it the maximum horizontal stress. Warpinski speculates that a possible application of the stress alteration concept is for the alteration of the vertical distribution of the minimum horizontal in-situ stress in a single vertical hole. This could be used to advantage if hydraulic fractures are propagating into undesirable zones.

U.S. Pat. No. 4,724,905 discloses the use of hydraulic fracturing in one well to control the direction of propagation of a second hydraulic fracture in a second well located nearby. The first well is fractured and the fractures will generally form parallel to the fractures in the natural fracture system. The hydraulic pressure is maintained in the first well and another hydraulic fracturing operation is conducted at a second well within the zone of in-situ stress alteration caused by the first hydraulic fracture. This patent states that the second hydraulic fracture initiates at an angle, often perpendicular, to the first hydraulic fracture.

U.S. Pat. No. 4,830,106 discloses the use of simultaneous hydraulic fracturing in at least two spaced apart wells to control the direction of propagation of the fractures. This simultaneous pressure causes the fractures to curve away from each well or towards each well depending on the relative position and spacing of the wells in this stress field and the magnitude of the applied far field stresses. These generated fractures may then intercept at least one natural hydrocarbon bearing fracture.

U.S. Pat. No. 4,834,181 discloses the alteration of in-situ stress conditions using sequential hydraulic fracturing. The well formation is hydraulically fractured causing at least one vertical fracture to form. Thereafter a plugging material is directed into the created fracture and the material is allowed to solidify. A second hydraulic fracture is formed which should divert around the plugged fracture. The steps of plugging, hydraulically fracturing and diverting the subsequently created fracture are continued until branched or dendritic fractures are caused to emanate into the formation from the wellbore. U.S. Pat. No. 4,687,061 teaches the simultaneous fracturing of a borehole at two different levels in a deviated well.

None of the above methods are totally satisfactory. The methods using two wells are complex and hard to control. Additionally, these methods typically are not practical in fields with well spacing requirements. In the method disclosed in U.S. Pat. No. 4,834,181, the direction of the sequential fracturing is not controlled from the wellbore and it is merely a matter of chance as to whether the branch fractures will run perpendicular to either the natural fractures in the formation or the earlier induced hydraulic fractures. U.S. Pat. No. 4,687,061 does not disclose a method to control the direction of the propagation of the fracture from the wellbore, nor does it disclose using the method in a vertical hole. The industry is still in need of a method which can with some predictability control the orientation of hydraulic fracturing from a single wellbore.

SUMMARY OF THE INVENTION

This invention provides for a method of controlling hydraulic fracture orientation in hydrocarbon bearing formations by first determining the anticipated fracture orientation of the hydrocarbon bearing formation. The wellbore generally is perforated or notched in the anticipated fracture direction and the formation is fractured forming a first fracture. A substance is then injected into the first fracture which will temporarily harden and the substance is allowed to harden. The formation is perforated or notched in a direction perpendicular to the original anticipated fracture orientation of the hydrocarbon bearing formation and refractured to form a second fracture. The second fracture should propagate in a direction away from that of the first fracture. In an alternative embodiment, it can first be determined whether the stress field around the first hydraulic fracture will be altered to allow a reversal of the stresses.

This invention also provides for a method of controlling hydraulic fracture orientation in hydrocarbon bearing formations by the use of simultaneous fracturing. In this embodiment the anticipated fracture orientation of the hydrocarbon bearing formation is determined. The formation is then perforated or notched in a direction parallel to the anticipated fracture orientation and perforated or notched in a direction perpendicular to the anticipated fracture orientation. The formation is then first fractured in the direction parallel to the anticipated fracture orientation and, while injection is proceeding in the first fracture, the formation is fractured in the direction perpendicular to the anticipated fracture orientation.

This method of simultaneous fracturing can also be performed by perforating or notching the formation parallel to the anticipated fracture orientation at one level in the hydrocarbon bearing formation and perforating or notching the formation perpendicular to the anticipated fracture orientation at another level in the hydrocarbon bearing formation. For both methods of simultaneous fracturing it can be first determined whether the stress around a first hydraulic fracture will be altered to allow a reversal of the stresses. Additionally, in a preferred embodiment the first fracture is allowed to extend 5 to 25 minutes before the second fracture is initiated.

DETAILED DESCRIPTION OF THE PREFERRED EMBODIMENT

The methods of the present invention allow for the control of the orientation of hydraulic fracturing of a well to promote greater productivity from the hydrocarbon bearing formation. This is accomplished by hydraulically fracturing the formation and propping and plugging the fractures which result. The formation is then perforated or notched in a direction angularly disposed relative to the anticipated fracture direction of the first hydraulic fracture. Preferably, this perforation will be within the range of 60° to 120° relative to the anticipated fracture direction of the first hydraulic fracture, and most preferably be at approximately 90° to the anticipated direction of the first hydraulic fracture. The presence of the first fracture will force the second fracture to propagate in a direction away from that of the first fracture. Several variations on this basic concept are also disclosed in this invention.

The most advantageous use of this method is in naturally fractured formations. In using this method the chance to intersect natural formations will be enhanced. This is especially important if the natural fractures have a similar orientation to the normally induced hydraulic fractures. This method is also useful in high permeability systems where greater fracture conductivity is desired. This system will produce fractures that will be at least equal to a fracture with double the fracture conductivity if the fractures become parallel after a short distance or with superior flow patterns if they become parallel after a long distance. The method is useful, however, even in low permeability formations because the formation will be more efficiently depleted using the two fracture configuration.

Hydraulic fracturing is well known in the industry. During a typical hydraulic fracturing operation, a slurry, including a viscous base fluid and a solid particulate material particularly referred to as a "proppant", is pumped down the well at sufficient pressure to fracture open the producing formation surrounding the well. Once a fracture has been created the pumping of the slurry is typically continued until a sufficient volume of the proppant has been carried by the slurry into the fracture. After a suitable time the pumping operation is stopped at which time the proppant residue will prop open the fracture in the formation, preventing it from closing. As a result of the fracture the flow from the producing formation is increased thereby increasing the wells production.

Figure 1:
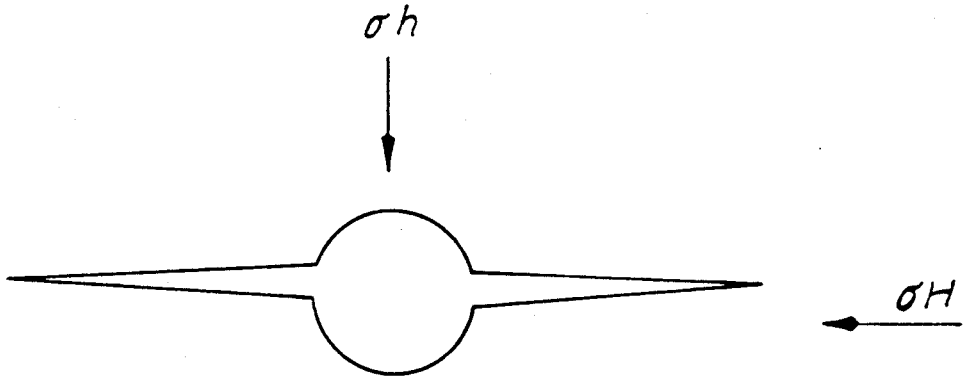
FIG. 1 depicts the minimum and maximum horizontal stresses and the normal fracture orientation under these conditions.

The three principal stresses in an underground formation are designated by $\sigma_V$, $\sigma_H$ and $\sigma_h$ (one vertical and two horizontal). The minimum horizontal stress is given the symbol $\sigma_h$ while the higher horizontal stress is given the symbol $\sigma_H$. In relatively deep formations, for example those below 2,000 ft., one of the horizontal stresses is usually the smallest of these three formation stresses. When the formation is hydraulically fractured the created fracture will typically propagate in the path of least resistance which, in most such situations, means a vertical fracture will result as illustrated in FIG. 1.

When a vertical well is drilled the stress distribution in the vicinity of the wellbore is altered. Stress distribution around a wellbore may be determined experimentally or analytically by the use of such techniques as microfrac testing or strain relaxation. As a first hydraulic fracture is created the state of stress may be further altered. If the difference between the minimum horizontal stress and the maximum horizontal stress is not too large, the stress around the wellbore may be reversed by the effect of the first hydraulic fracture such that the stress parallel the first hydraulic fracture is not the smallest any longer. If the stresses are reversed, a second hydraulic fracture will typically propagate in a direction perpendicular to the first hydraulic fracture.

The preferred method to measure these stresses is microfrac testing. A microfrac test is basically a small scale or microhydraulic fracturing operation utilizing a small quantity of fracturing fluid, without proppant, to create a test fracture. Typically, one to two barrels of fracturing fluid are injected into the subsurface formation at an injection rate of between two and twenty gallons per minute. As is well known to those skilled in the art, the injection rate and fracturing fluid volume necessary to initiate and propagate a fracture for 10 to 20 ft. depend upon the subsurface formation and fracturing fluid properties (Kuhlman, Microfrac Tests Optimize Frac Jobs, *Oil & Gas Journal*, 45-49 (Jan. 1990)). (Incorporated herein by reference.)

After fracturing, the injection of the fluid is typically stopped and the well is shut in or the fracturing fluid is allowed to flow back at a prescribed rate. The newly created fracture begins to close upon itself since fluid injection has ceased. In either situation test pressure versus time data is acquired. Fracture theory predicts that the fluid pressure at the instant of fracture closure is a measure of minimum principal stress of the formation. (Daneshy et al., In-situ Stress Measurements During Drilling, *Journal of Petroleum Technology*, 891-898 (August 1986)) (Incorporated herein by reference).

Methods for estimating the maximum horizontal stress from microfrac testing have also been developed. Usually several microfrac cycles are performed, meaning that the fracture is reopened several times. The reopening pressure is a function of both minimum and maximum horizontal stress. Since minimum horizontal stress is determined independently, reopening pressure is used to calculate maximum horizontal stress. The horizontal stresses also may be calculated using known strain relaxation techniques (Teufel L. W., Determination of In-Situ Stress from Anelastic Strain Recovery Measurements of Oriented Core. *SPE DOE* 11649) (Incorporated herein by reference).

Using the above-measured stress values it can be determined whether the stress field around a first hydraulic fracture will be altered enough to allow a reversal of the stresses. It has been shown that creating a fracture alters a state of stress. This can be calculated using equations given by Sneddon. (Sneddon and Elliott. The Opening of A Griffith Crack Under Internal Pressure. *Quarterly of Applied Mathematics*. Vol. 4. No. 3. p. 262 (1946). Green and Sneddon. Distribution of Stress in the Neighborhood of A Flat Elliptical Crack of An Elastic Solid. *Proceedings Cambridgee Phil. Soc.*. pp. 159-163 (January. 1949)) (Incorporated herein by reference) Snedden gives the stress field around an infinitely long 2D crack in a homogenous. isotropic elastic body having Poisson's ratio and the geometry shown as follows:

$$\frac{1}{2}(\sigma_x - \sigma_y) = P\left\{\frac{r}{\sqrt{r_1 r_2}}\cos\left[\Theta - \frac{1}{2}\Theta_1 - \Theta_2)\right] - 1\right\} \quad \text{eq. 1}$$

$$\frac{1}{2}(\sigma_y - \sigma_x) = P\left\{\frac{r\sin\Theta}{c}\left(\frac{c}{r_1 r_2}\right)^{3/2}\sin\frac{3}{2}(\Theta_1 - \Theta_2)\right\} \quad \text{eq. 2}$$

$$\tau_{xy} = P\left\{\frac{r\sin\Theta}{c}\left(\frac{c^2}{r_1 r_2}\right)^{3/2}\cos\frac{3}{2}(\Theta_1 - \Theta_2)\right\}\text{and} \quad \text{eq. 3}$$

$$\sigma_z = \nu(\sigma_x - \sigma_y). \quad \text{eq. 4}$$

Where:

$\sigma_x$, $\sigma_y$, and $\sigma_z$ represent stresses induced by fracture in cartesian coordinate directions.

In Eqs. 1-4. P is the internal pressrue. c is the crack half height (H/2). and the geometric relations are given by:

$$r = \sqrt{x^2 + y^2} \qquad \Theta = \tan^{-1}(x/y)$$

$$r_1 = \sqrt{x^2 + (y + c)^2} \qquad \Theta_1 = \tan^{-1}(x/(-y - c))$$

$$r_2 = \sqrt{x^2 + (y - c)^2} \qquad \Theta_2 = \tan^{-1}(x/(c - y)$$

Negative values of $\Theta$, $\Theta_1$, and $\Theta_2$, should be replaced by $\pi+\Theta$, $\pi+\Theta_1$, and $\Theta_2$, respectively. Examination of Eqs. 1-4 also suggests that all stresses can be normalized by the pressure, P, and all lengths can be normalized by the half height, c=H/2.

Equations 1-4 may be used to calculate the decay of the stress field with distance away from the fracture. It also can be predicted whether reversal of stresses will occur. Thisreversal will take place when $\sigma_h+\sigma_x>\sigma_H+\sigma_z$, where $\sigma_h$ and $\sigma_H$ are the minimum and maximum horizontal principal stresses. This calculation assumes that the fracture is long enough relative to the wellbore radius that it can be considered infinite, a good approximation in the practical application of this technique.

Figure 2:
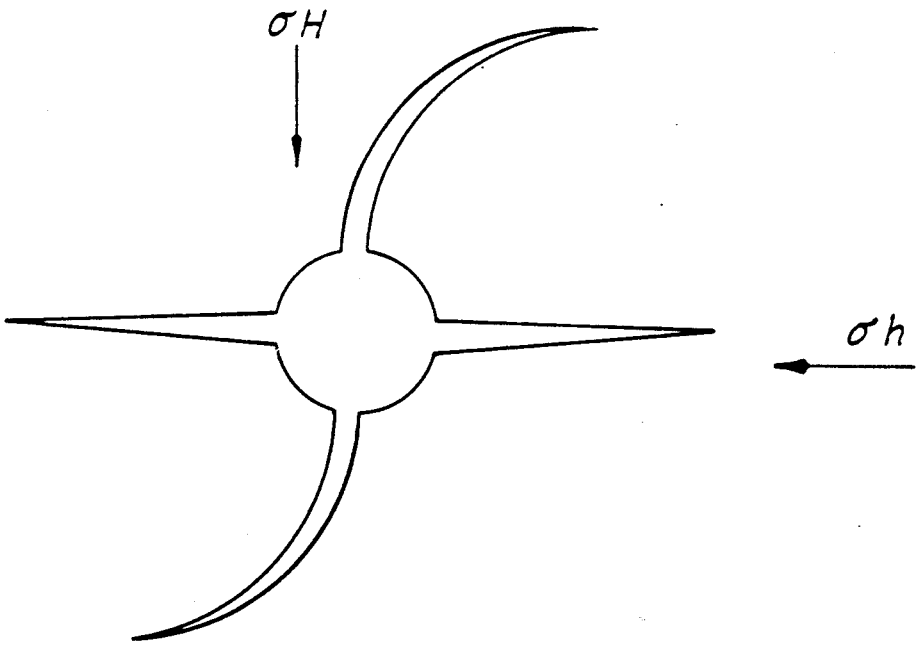
FIG. 2 depicts the orientation of a second hydraulic fracture after the direction of propagation has been altered in accordance with the present invention.

If the calculation shows that the stress field is altered, then another hydraulic fracture, assuming the first one is temporarily plugged, should propagate in a direction different from the original one as shown in FIG. 2. This reoriented propagation is enhanced by preferential perforation or notching as disclosed below. In the most preferred method the above measurements and calculations are performed. It is not, however, necessary to perform the above steps. As a general rule the difference between the two horizontal stresses in a given formation will not be large enough to prevent the reversal of the stress field. Therefore this invention also includes embodiments in which the initial calculations are not performed.

There are several different possible applications of this method. The most preferred method is as follows. The natural fracture orientation of the reservoir is determined. This may be done by several analytical or experimental methods including, but not limited to, microfracture, strain relaxation analysis which measures the time dependent swelling of a core sample as soon as it reaches the surface and borehole televiewing which can be used in an open hole to view natural fracture orientation. After the fracture orientation of the reservoir has been determined, the formation is perforated in the direction of the expected fracture orientation. For example, if the direction of the minimum horizontal stress indicates that the formation will fracture in an east/west direction, the formation should be perforated in an east/west direction.

The methods of perforating are well known by those skilled in the art and are extremely numerous. Any method of perforating which allows for directionally orienting the perforations can be used in this invention. The formation could also be notched in the appropriate direction. Any controlled notching technique can also be used, for example, but not limited to, hydraulic notching using hydraulic jets to notch the formation.

The formation is then fractured with appropriate fracture pressure and fracturing fluids. These parameters may be determined by various methods which are known to those skilled in the art. The fluid must contain an appropriate proppant to hold the formation open once the hydraulic pressure in the fracture is reduced. After the fracture has closed onto the proppant some type of substance which will plug the fracture is injected into the fracture and allowed to harden.

The plugging material which is used should only be temporary. This material could be a breakable gel or some type of a fluid which will harden once it is injected into the formation. The temporary plugging material may be any one of a number of commonly used materials provided it is compatible with the overall treating system. Examples of such materials include polysaccharides, such as guar gums, derivatized guar gum, and derivatized cellulose which may be crosslinked to form rigid gels, or polymerizable materials such as acrylamide, styrene or silicates which also can form rigid gels. Additives may be included in the plugging materials which will cause the gels to break up subsequent to the treatment. Alternatively, subsequent treatments may be performed which will break the gels. These treatments may include enzymes, oxidizers, reducers and acids. One example of an appropriate compound is Temblok TM. (Halliburton Services, Inc., Duncan, Okla.). The plugging material must remain hard long enough to allow for the second hydraulic fracturing procedure to be completed.

After the plugging material hardens the formation is perforated or notched as described above in a direction perpendicular to the original fracture. For example, if it was determined that the original fracture should propagate in an east/west direction then the formation should be notched or perforated in a north/south direction. The borehole should be perforated or notched at a depth which is approximately in the middle of the hydrocarbon bearing formation. The formation is then again hydraulically fractured with the appropriate fracturing fluid and proppant. The presence of the first fracture together with the directional perforating or notching will force the second fracture to propagate in a direction away from the first fracture.

A variation of this method may also be employed. Again the orientation of the hydraulically induced fracture is determined as described above. It is determined, if desired, whether the stress field around a first hydraulic fracture can be altered to allow a reversal of the stresses. The formation is then perforated or notched in both a parallel and perpendicular direction to the expected fracture orientation. A tool is then set that will allow injection of fracturing fluids and proppant in either direction and with which the direction of injection may be controlled. A selective injection packer or pin-point injection packer tool can be used in this method. This tool comprises opposing cups or packer types that isolate the perforations to be treated. The spacing between the cups can be adjusted as necessary. Same means, such as a ball and seat or ball valve must be used to close off the center opening below the tool and force the treating or washing fluid through ports between the cups.

A concentric bypass can be built into the selective injection packer tool to allow pressure to equalize from the top to below the bottom cup. This concentric bypass also provides a means of reversing around the bottom of the tool to remove the ball from the seat allowing the fluid to reverse out of the tubing. Other types of tools that could be utilized include sliding sleeves or selective crossover tools.

The formation is first hydraulically fractured using the perforations or notches which run in a direction parallel to the anticipated fracture orientation. The fracture should be extended about 5 to 25 minutes, the preferred time being about ten minutes. Preferably the fracture should extend at least 50 feet. As injection is proceeding in the direction parallel to the expected fracture orientation the formation is hydraulically fractured using the perforations or notches which are perpendicular to the fraction orientation direction. It is believed that the effect of the first fracture will orient the second fracture in a direction perpendicular to the original fracture direction.

A second method of simultaneously fracturing the formation may also be utilized. In this method the perforations or notches are not created at the same level but at different levels in the formation. The distance between the levels depends on the formation thickness and properties. The optimum distance between levels should range from about 5 to 10 feet. Again, the first step is to determine the fracture orientation in the formation.

Fracturing at different levels can be done in a variety of ways known to those skilled in the art. One way to perform this operation is to utilize a sand plug. In this case, the lower fracture is fully created and the wellbore is filled with sand up to the bottom of the upper perforations. This will prevent fluid flow into the lower fracture. Alternatively, a fluid such as Temblock TM could be utilized.

In a preferred method of practicing the invention, the first fracture is created by the injection at the lower level of an appropriate fracturing fluid and proppant through the tubing. The fracture is allowed to extend for 5 to 25 minutes preferably about ten minutes. As injection is proceeding the second fracture is created using the perforating or notching in the higher level by injecting the appropriate fracturing fluid and proppant through the annulus. Again it is believed that the stresses created by the first fracture as well as the preferential directional notching or perforating will cause the second fracture to start propagating in a direction away from the first fracture.

While the invention has been described in terms of certain embodiments those skilled in the art will readily appreciate that various modifications, changes, substitutions and omissions may be made without departing from the spirit and scope of this invention.

We claim:

1. A method of controlling hydraulic fracture orientation in hydrocarbon bearing formations penetrated by a wellbore comprising the steps of:

determining the anticipated fracture orientation of the hydrocarbon bearing formation;

perforating or notching the wellbore within the formation in a direction parallel to the anticipated fracture orientation;

perforating or notching the wellbore within the formation in a direction perpendicular to the anticipated fracture orientation;

first fracturing the formation in the direction parallel to the anticipated fracture orientation by injecting a fluid through said wellbore and into said formation; and while injection is proceeding in the first fracture, fracturing the formation in a direction perpendicular to the anticipated fracture orientation.

2. The method of claim 1 adding the further step of determining whether the stress field around a first hydraulic fracture will be altered to allow a reversal of the stresses.

3. The method of claim 1 wherein the first fracture is allowed to extend for 5 to 25 minutes, before the second fracture is initiated.

4. The method of claim 1 wherein the perforating or notching parallel to the anticipated fracture orientation in the well bore is done at one level in the hydrocarbon bearing formation and the perforating or notching perpendicular to the anticipated fracture orientation in the wellbore is done at another level in the hydrocarbon bearing formation.

5. The method of claim 4 wherein the further step of determining whether the stress field around a first hydraulic fracture will be altered to allow a reversal of the stresses.

6. The method of claim 4 wherein the first fracture is allowed to extend for 5 to 25 minutes, before the second fracture is initiated.

7. A method of controlling hydraulic fracture orientation in a hydrocarbon bearing formation penetrated by a wellbore comprising the steps of:

determining the anticipated fracture orientation of the hydrocarbon bearing formation;

perforating or notching the wellbore in the formation in a direction substantially parallel to the anticipated fracture orientation;

perforating or notching the wellbore in the formation in a direction of about 60° to 120° relative to the anticipated fracture orientation;

introducing a first fracturing fluid through the wellbore under conditions sufficient to fracture the formation in the direction substantially parallel to the anticipated fracture orientation; and while the first fracture is maintained in an at least partially open condition by the presence of said fracturing fluid, fracturing the formation in a direction substantially perpendicular to the anticipated fracture orientation by injection of a second fracturing fluid through said perforations or notches located about 60° to 120° relative to the anticipated fracture orientation.

8. The method of claim 7 wherein said first and second fracturing fluids have substantially the same composition.

9. The method of claim 7 wherein the first fracture is allowed to extend for from about 5 to about 25 minutes before the second fracture is initiated.

10. The method of claim 7 wherein the perforating or notching parallel to the anticipated fracture orientation in the wellbore is done at one level in the wellbore in the hydrocarbon bearing formation and the perforating or notching at 60° to 120° relative to the anticipated orientation is done at another level in the wellbore within the hydrocarbon bearing formation.

11. The method of claim 10 wherein the levels of the perforations or notches in the wellbore are spaced from about 5 to about 10 feet apart.

* * * * *